252-105 AU 166 EX
1/6/81 OR 4,243,543

United States Patent [19]

Guilbert et al.

[11] 4,243,543

[45] Jan. 6, 1981

[54] STABILIZED LIQUID ENZYME-CONTAINING DETERGENT COMPOSITIONS

[75] Inventors: C. Carol Guilbert, St. Paul; William H. Scepanski, Burnsville, both of Minn.

[73] Assignee: Economics Laboratory, Inc., St. Paul, Minn.

[21] Appl. No.: 38,020

[22] Filed: May 11, 1979

[51] Int. Cl.[3] ..... C11D 7/54; C11D 7/42

[52] U.S. Cl. ..... 252/105; 252/174.12; 252/DIG. 12; 252/DIG. 14

[58] Field of Search ..... 252/174.12, 105, DIG. 12, 252/DIG. 14; 195/63, 65

[56] References Cited

U.S. PATENT DOCUMENTS

| | | | |
|---|---|---|---|
| 3,634,266 | 1/1972 | Theile et al. | 252/DIG. 12 |
| 3,676,374 | 2/1972 | Zaki et al. | 252/DIG. 12 |
| 3,697,451 | 10/1972 | Mausner | 252/DIG. 12 |
| 3,746,649 | 7/1973 | Barrett | 252/DIG. 12 |
| 4,021,377 | 5/1977 | Borchert | 252/DIG. 12 |

*Primary Examiner*—Mayer Weinblatt
*Attorney, Agent, or Firm*—Merchant, Gould, Smith, Edell, Welter & Schmidt

[57] ABSTRACT

Enzyme activity of liquid proteolytic enzyme-containing detergent compositions is stabilized by adding an antioxidant and a hydrophilic polyol and stabilizing the pH of the composition.

14 Claims, No Drawings

STABILIZED LIQUID ENZYME-CONTAINING DETERGENT COMPOSITIONS

CROSS REFERENCE TO RELATED APPLICATION

This application includes subject matter which is related to a copending, commonly owned application of C. Carol Guilbert, i.e. U.S. Ser. No. 908,505, filed May 22, 1978.

FIELD OF THE INVENTION

This invention relates to aqueous liquid detergent compositions containing proteolytic enzymes, wherein the proteolytic activity of the enzyme has been generally stabilized against deterioration, e.g. denaturization or degradation of the enzyme molecule. An aspect of this invention relates to a method for stabilizing the proteolytic enzymes in the detergent composition against degradation. The stabilized liquid enzyme-containing detergent compositions of the invention have a variety of uses, e.g. in methods for removing proteinaceous soils from fabric and hard surfaces and in "c.i.p." (cleaning-in-place) techniques for cleaning apparatus.

DESCRIPTION OF THE PRIOR ART

It has long been recognized that it is difficult to stabilize enzymes in liquid enzyme-containing detergent compositions. Most enzymes are reasonably stable in solid detergent compositions, and the approach of using a "100% active" liquid detergent compositions has also been suggested as an approach for preserving enzyme activity; see U.S. Pat. No. 3,697,451 (Mausner), issued Oct. 10, 1972. Typically, however, liquid detergents (even liquid detergent "concentrates") contain more than 20 or 30% by weight of water, and there is a definite need for a technique of stabilizing the enzymes in such aqueous or generally aqueous systems.

A considerable variety of approaches to the stabilization of enzymes in aqueous or generally aqueous liquid, enzyme-containing detergents has already been suggested in the patent literature. These approaches can be briefly summarized as follows:

a. The water-compatible organic liquid or polyhydroxy organic solid approach. According to the patent literature, various alcohols (i.e. mono-ols), polyols, ethers (including diethers and alkoxy-substituted alcohols), esters, sugars, and the like have a stabilizing effect upon various types of enzymes, including carbohydrases, lipases, proteases, etc.

b. Calcium salts. Water soluble calcium salts have been used to stabilize these enzymes, and some workers prefer to combine calcium salts with other materials such as proteins, sodium thiosulfate, or monomeric or polymeric glycols.

c. Solubilized proteins. In addition to using the combination of calcium salts with proteins, proteins have also been combined with glycerol to provide an enzyme-stabilizing system.

As representative of the patent literature in this field, see the following:

U.S. Pat. No. 3,697,451 (Mausner), issued Oct. 10, 1972.

U.S. Pat. No. 3,676,374 (Zaki et al), issued July 11, 1972.

U.S. Pat. No. 3,627,688 (McCarty), issued Dec. 14, 1971.

U.S. Pat. No. 3,557,002 (McCarty), issued Jan. 19, 1971.

U.S. Pat. No. 3,325,364 (Merritt et al), issued June 13, 1967.

U.S. Pat. No. 3,296,094 (Cayle), issued Jan. 3, 1967.

U.S. Pat. No. 3,634,266 (Theile et al), issued Jan. 11, 1972.

U.S. Pat. No. 3,819,528 (Berry), issued June 25, 1974.

U.S. Pat. No. 3,761,420 (Bogardus), issued Sept. 25, 1973.

U.S. Pat. No. 3,746,649 (Barrett), issued July 17, 1973.

U.S. Pat. No. 4,021,377 (Borchert), issued May 3, 1977.

German laid-open application No. 2,150,142 (AKZO, N.V.), laid-open Apr. 13, 1972.

SUMMARY OF THE INVENTION

It has now been found that the combination of an antioxidant having a standarized redox potential at least equal to that of ascorbic acid but less than that of sodium hydrosulfite, with a hydrophilic polyol is an unusually effective stabilizing system for proteolytic enzymes, provided that the enzyme-containing aqueous liquid detergent composition can be maintained in a generally pH-stable condition. In other words, a class of reducing agents or antioxidants has been discovered which is well-matched to the oxygen sensitivity of proteolytic enzymes specifically. The polyol, for reasons which are not readily apparent, optimizes the preservative or stabilizing effect of the antioxidant. Since the most preferred antioxidants have a tendency to cause downward shifts in pH as they are oxidized (e.g. because of air oxidation), it is normally important to maintain the pH of the detergent composition above 5.2, so as to preserve enzyme activity. Excessive alkalinity is not desirable either, however, and a pH above 9.0 should be avoided. The preferred means for maintaining the desired pH range is to include in the composition a water soluble chemical which acts as a buffering agent. One type of water soluble chemical suitable for this purpose is a proton acceptor with a $pK_a$ within the range of about 6 to about 12. Such proton acceptors put a floor under the pH by neutralizing acid products or by-products resulting from the oxidation of the antioxidant-stabilizer; in addition, by forming strong acid/-weak base salts in situ, these water soluble chemicals also help to provide some buffering against upward pH shifts.

Stated another way, a stabilized, liquid, enzyme-containing detergent composition of this invention comprises:

(a) 20–90% by weight of water;

(b) a proteolytically effective amount of a proteolytic enzyme distributed throughout said water;

(c) 1–70% by weight of an anionic and/or nonionic surfactant uniformly distributed through the water; and (d) 0.5–30% by weight of a water-dispersible stabilizing system for the proteolytic enzyme, which is also distributed throughout the water phase.

The stabilizing system comprises the combination of a water-dispersible antioxidant and an organic, hydrophilic, water-soluble polyol having a molecular weight less than about 500. As noted previously, the composition should be pH-stabilized, preferably by means of the aforementioned buffering agent. In order to match the reducing redox potential of the antioxidant to the class of enzymes it is to protect, the standardized single electrode potential at 25° C. (expressed as the oxidation of the antioxidant to an oxidized species), i.e. the $E^{\circ}_{ox}$ should be at least equal to that of ascorbic acid but less than that of sodium hydrosulfite. The preferred antioxidants are water-soluble salts containing an oxidizable, oxygenated-sulfur anion (e.g. alkali metal sulfites, bisulfites, metabisulfites, thiosulfates, but not hydrosulfites), all of which tend to cause downward pH shifts as a result of difficult-to-control phenomena such as air oxidation. Sodium hydrosulfite ($Na_2S_2O_4$) is too strong a reducing agent for use in this invention. Rather than protect oxidizable portions of the proteolytic enzyme molecules, this compound appears to attack the enzymes and denature them.

Thus, an aspect of this invention is a method for stabilizing a proteolytic enzyme-containing detergent composition against deterioration of the enzyme activity by dispersing the enzyme in the water/polyol liquid phase and protecting oxidizable portions of the enzyme molecule with the aforementioned antioxidant.

The primary area of application for stabilized, liquid, enzyme-containing detergent compositions of this invention is in the field of removing proteinaceous stains from fabric through conventional laundering techniques.

DEFINITIONS

Throughout this description, the following terms have the indicated meanings.

"Uniformly distributed" means dissolved, dispersed, or emulsified. A dispersed phase is one which does not settle, due to its very fine particle size, typically in the micron or sub-micron range. If the amount of the material to be dispersed is very small (as in the case of the proteolytic enzyme), larger particle sizes are permissible. In the case of the anionic or nonionic surfactant (assuming the surfactant is not water soluble), good dispersions can be obtained through an emulsifying and/or micelle-forming effect, and, again, larger particle sizes are permissible.

"Single electrode potential at 25° C. for oxidation to an oxidized species" refers to the $E^{\circ}_{ox}$, i.e. the value of volts for the single electrode potential at 25° C. when each substance involved in the electrode reaction is at unit "activity". The value of $E^{\circ}_{ox}$ is numerically the same as $E^{\circ}_{red}$, but is opposite in sign. An example of a reaction describing the single electrode potential for the oxidation of an oxidizable antioxidant or reducing agent would be as follows:

$$X^{--} \rightarrow X^{-} + e^{-}$$

wherein $X^{--}$ is an oxidizable anion, and $X^{-}$ is the oxidized species resulting from the electron reaction. Another term for $E^{\circ}$ is the "standardized redox potential".

"Buffering agent" means any agent of combination of agents which, when dissolved in a suitable solvent, produces a solution which resists pH changes which might occur due to changes in the environment of the solution, additions to the solution, or spontaneous reactions occurring within the solution itself. This term is intended to include buffering salts which are formed in situ as a result of the addition of the "buffering agent".

"Oxygenated-sulfur anion" means anions containing one or more sulfur atoms covalently bonded to one or more oxygen atoms.

DETAILED DESCRIPTION

As noted previously, this invention involves the discovery that antioxidants with suitable $E^{\circ}_{ox}$ values can be combined with suitable polyols in a pH-stabilized protease-containing detergent composition to impart a surprising shelf life to the protease component of the composition. For example, it is well within the capabilities of preferred protease-stabilizing systems of this invention to maintain at least 80% of the initial enzyme activity over a period of at least two months (i.e. two months from the time that the detergent composition was formulated). Although this invention is not bound by any theory, it is believed that each class of enzymes has its own particular stability problems, and the proteases or proteolytic enzymes generally contain tyrosine and/or tryptophan and/or methionine and/or histidine units and/or disulfide (—S—S—) bonds which are, from the standpoint of air oxidation or other types of oxidation, weak points in the polypeptide structure of the proteolytic enzyme. (Tryptophane or tryptophan is 1-alpha-aminoindole-3-propionic acid, tyrosine is beta-[p-hydroxy-phenyl]alanine, methionine is 2-amino-4(methylthio) butyric acid, and histidine is alpha-amino-beta-imidazoleopropionic acid).

The aforementioned polyols are believed to help protect initial enzyme activity through an entirely different mechanism. Although this invention is not bound by any theory, it is presently theorized that the polyol either reduces free water in the aqueous enzyme-containing detergent composition or inhibits bacterial attack on the enzyme or both. Based upon the teachings of the prior art regarding these polyols, it presently appears that the effect of the polyol is not specific for any one type of enzyme, beneficial effects upon the stability of carbohydrases and lipases as well as proteases having been reported. Nevertheless, for reasons which are not readily apparent, the combination of the polyol with the antioxidant appears to provide striking superiority of protection of protease activity, when compared to either the polyol or the antioxidant alone.

Unfortunately, the most preferred antioxidants used in this invention have a tendency to eat up hydroxyl ions as they are converted to their respective oxidized species. The result is a pH shift which can be sufficiently severe to bring the pH of the detergent composition down below 5.5 or even 4.5. As is known in the art, many proteolytic enzymes becomes relatively inactive at these low pH levels. However, it was surprising to discover the extent to which air oxidation or the like could occur in a closed container of detergent composition, whereby this pH shift could be sufficiently severe to partially deactivate the protease. The aforementioned buffering agent provides a means for combatting such pH shifts.

In the description which follows, the various components of the stabilized, liquid, enzyme-containing detergent compositions of this invention will be described in greater detail.

THE WATER PHASE

Protease-containing detergents of this invention are essentially aqueous liquid detergent compositions, although they can be produced and distributed either in "concentrate" form or in a form suitable for the ultimate user. Typical uses for enzyme-containing liquid detergents include presoaking of clothes or other fabric (to aid in removal of stains), commercial laundering and so-called on-premise laundering (both of which typically involve agitator or tumbling action), high-forming treatment of soils (sometimes called the "foam and clean" approach, which is a system for prolonging the contact time between the cleaning solution and the substrate), and even in some applications of hard-surface cleaning technology (e.g. machine dishwashing). The use of on-premise laundries is becoming widespread. No longer do many inns, restaurants, hospitals, nursing homes, or the like send out laundry to commercial laundries; rather, many of these institutions now are able to do their own laundry on their own premises. This growth of on-premise laundering is believed to stem from the introduction and widespread use of wash-and-wear fabrics, which reduce the need for ironing and thereby simplify overall laundering procedures. The "foam and clean" approach appears to be entering a period of expansion also. The advantage of this approach is that the volume of detergent solution used for cleaning may be less than would be required by soak or recirculated spray washing. Furthermore, the operator can visually see the areas covered by foam as well as visually see where the area is subsequently rinsed off without missing an area. Still further, the soil-detergent contact time may be substantially increased by allowing the foam to linger on the surface for the desired time period. One important application of the foam and clean technique has been in cleaning large equipment or areas of food processing plants. For a typical foam and clean system, see U.S. Pat. No. 3,961,754 (Kuhns et al).

In both foam and clean systems and in on-premise laundering washing machines using automatic wash programming devices, the enzyme detergent is preferably compatible with the laundry program control system and other cleaning systems. It is difficult to adapt powdered products to many such systems, whereas liquid products are relatively easily utilized in these same systems. As is well known in the art, the liquid detergent can either be in a concentration suitable for direct introduction into the wash cycle or can be in a much more concentrated form. It is also known that a "concentrate" need not even be pre-diluted; a concentrate stream can be blended with a water stream to provide "in line" dilution. Still further, a "concentrate" may be more economical to ship in view of its higher concentration of active ingredients.

Although the principles of this invention can be embodied in a "concentrate", there is nevertheless a practical lower limit on water content for enzyme-containing detergent concentrates made according to this invention. For ease of dilution and a variety of other reasons; it is generally preferred that the concentrate as formulated contain a significant amount of water. Stated another way, it is preferred that the detergent concentrate have an aqueous phase, even though this aqueous phase may contain co-solvents or the like. As formulated, a detergent concentrate will typically contain at least 20% by weight of water. If diluted or pre-diluted to a suitable "use" concentration, a detergent composition of this invention can contain as much as about 90% or more by weight of water.

Softened-water, distilled water, deionized water, or the like are preferred. By "softened-water" is meant water with a low level of hardness (calcium and/or magnesium ion). Softened-water in commercially useful quantities is available at hardness levels below 10 ppm and even as low as 0 ppm.

For all practical purposes, essentially all of the ingredients of this composition are uniformly distributed through the aqueous phase. The uniform distribution can be by a variety of mechanisms, including solution, dispersion, emulsification, and the like. For example, thickeners (either inorganic or organic polymeric) can be dispersed throughout the aqueous phase as particles or droplets which are in the micron or sub-micron size range, e.g. less than 25 microns in size. Coloring agents may be dispersed or dissolved. Nonionic and anionic detergents can be either dispersed or emulsified or dissolved, depending upon the hydrophobe/hydrophile balance of the detergent molecule. Some poly(oxyalkylene)polyols, for example, dissolve in water at normal ambient temperatures and tend to form a single phase. Other, less hydrophilic poly(oxyalkylene)polyols tend to form a micelle-like dispersed or emulsified phase rather than a true solution. The same can be said of typical synthetic organic anionic detergents, wherein, typically, the nature and/or length of the organic "tail" determines cloud point or other indicia of water compatability.

The proteolytic enzymes useful in this invention are ordinarily available in either powdered or slurried form. Either form can be uniformly distributed throughout the aqueous phase; however, the slurry form is generally easier to introduce into the aqueous medium.

The proteolytic enzyme-containing system of this invention should be capable of being uniformly distributed throughout the aqueous phase. That is both the antioxidant and the organic, hydrophilic polyol will be water-dispersible, and in most cases water-soluble. If a buffereing agent is used to stabilize the pH, it will typically be water soluble.

Other ingredients suitable for use in compositions of this invention are typically water soluble and can also be considered to be uniformly distributed throughout the aqueous phase.

THE PROTEOLYTIC ENZYME OR PROTEASE

Compositions of this invention include a proteolytically effective amount of a proteolytic enzyme, a class of enzymes generally referred to as proteases. Vegetable sources for proteolytic enzymes are known, e.g. papaya, pineapples, and the like; papain being typical of such proteases from vegetable sources. However, the more common practice from a commercial standpoint is to make large quantities of proteolytic enzymes from spore-forming organisms such as *Bacillus species* and *Bacillus subtilis*. Typical disclosures of commercially available proteases are also contained in a number of previously cited references, including U.S. Pat. No. 3,627,688 (McCarty), issued Dec. 14, 1971 (see particularly column 3, line 27 et seq), U.S. Pat. No. 3,557,002 (McCarty), issued Jan. 19, 1971, and U.S. Pat. No. 3,746,649 (Barrett), issued July 17, 1973 (see particularly column 1, line 67 et seq).

As noted previously, these enzymes have a protein-like or polypeptide structure made up of repeating amino acid units; that is, the —COOH function of a first amino acid unit combines with an amino function of a second amino acid unit to form the peptide linkage which is in essence an amide linkage. The preferred proteolytic enzymes used in this invention typically contain tyrosine and/or tryptophan and/or methionine and/or histidine units, all of which are sensitive to oxidation. Much of the loss of proteolytic enzyme activity when the enzyme is distributed through a water phase is believed to stem from degradation or attack upon these units, which attack is essentially an oxidation process or is accelerated by the presence of air or oxygen. Other types of useful enzymes can contain cysteine units. The cysteine-type amino acids contain disulfide (—S—S—) bonds which can also be sensitive to oxidative attack.

Another important facet of the preferred proteolytic enzymes utilized in this invention is their pH sensitivity. Many of these enzymes lose a substantial amount of activity or otherwise become less effective at a pH below 5.2 or above 9.0; adverse effects upon proteolytic enzyme activity can be observed at a pH as high as 5.5 or as low as 8.0. A particularly preferred pH for compositions of this invention is 6.0 to 8.0.

As will be apparent from the foregoing disclosure, the terms "proteolytic enzyme" and "protease" are used generally synonymously in this description. The "proteases" are generally considered to include enzymes which hydrolyze peptide linkages, regardless of whether the peptide linkage is part of a low molecular weight polypeptide (e.g. a polypeptide containing only a few amino acid units) or part of that class of compounds truly called proteins, which typically contain more than 100 amino acid units and have molecular weights in the thousands, tens of thousands, or hundreds of thousands. Most typically, of course, enzymes will be selected for this invention on the basis of their ability to attack proteinaceous stains, such as blood stains, milk stains, cocoa stains, other food stains, and certain types of stains from vegetable matter (e.g. grass stains). The products of the attack upon the proteinaceous stains can be individual amino acid units ore relatively low molecular weight polypeptides or both.

Various techniques are known for measuring or estimating proteolytic enzyme activity. One well known procedure is based upon the ability of the enzyme to hydrolyze a solution or dispersion of casein (see, for example, Anson, M. L., J. Gen Physiol., 22 79 (1938) and Kuntz, M. J., J. Gen. Physiol., 30, 291 (1947)). Natural products containing casein (e.g. skim milk) can also be used in this type of test.

The test is based upon the fact that hydrolysis of casein by the enzyme produces relatively low molecular weight fragments (e.g. amino acids) as well as relatively large fragments (e.g. polypeptide). The smaller fragments which remain in solution after precipitation of the larger fragments by acid-precipitation have a characteristic absorption peak for spectrophotometric analysis being at 270–280 millimicrons. The concentration of the small, soluble fragments (hence the optical density of the test solution) is considered to be related to enzyme activity and a reasonably reliable indicator of this activity. Accordingly, the procedure utilized herein to measure enzyme activity is as follows:

(a) A standard solution of casein is used as the substrate for the proteolytic enzyme.

(b) After the enzyme has been mixed with the casein solution and the reaction has taken place, the relatively high molecular weight fragments are precipitated with trichloroacetic acid.

(c) The filtrate is then ready for spectrophotometric analysis for optical density or percent transmission at the 270–280 millimicron absorption peak.

Following this procedure, one casein unit per gram (cu/g) is considered to be the amount of increase in soluble casein molecular fragments needed to produce an increase in optical density of 0.1. In typical proteolytic enzyme-containing detergent compositions of this invention, original protease assays by this spectrophotometric technique show original activities (i.e. in freshly formulated detergent compositions or concentrates) ranging from about 100 to about 1,000 cu/g. In the preferred embodiments of this invention, at least 80% of this initial enzyme activity is found to be present after two to four months of storage at 37° C. (93° F.). In some tests, no loss or negligible losses of enzyme activity were observed after two or three months of storage at 37° C. Indeed, because of the nature of the test, it is actually possible to observe an apparent increase in enzyme activity after some period of storage.

Two particularly preferred proteolytic enzymes used in compositions of this invention are "PB Enzyme", trade designation of a product of G. B. Fermentation, Inc., of Des Plaines, Illinois, U.S.A., and "Esperase Enzyme", trade designation for a product of Novo Enzyme Corporation, of Mamaroneck, New York, U.S.A. Both of these commercially available enzymes can be obtained as slurries, which are somewhat easier to disperse in the aqueous detergent composition as compared to dry powders, and 0.5–2 parts of slurry by weight (based on the total weight of the detergent composition) provides a typical initial enzyme activity. As in U.S. Pat. No. 3,819,528 (Berry), issued June 25, 1974, a detergent composition can be prepared to contain from about 0.001 to about 1% enzyme by weight of the aqueous composition on a pure enzyme basis. (Although the enzymes disclosed in the Berry patent are amylolytic, this percentage range is considered fairly typical for other classes of enzymes as well; see Bogardus, U.S. Pat. No. 3,761,420, issued Sept. 25, 1973, column 3, line 10 et seq.)

The proteinaceous soil-removing capabilities of detergent compositions of this invention are believed to be very significant in today's marketplace. Except under unusual conditions, other types of stains, e.g. stains comprising carbohydrate or lipophilic materials can be efficiently removed by other means, e.g. anionic or nonionic detergents. The proteases, however, are believed to provide a significant contribution to the efficiency of a liquid detergent composition, particularly in laundering and foam-and-clean applications. In today's marketplace, detergent manufacturers can no longer rely as heavily upon phosphate-containing detergents and hot water washing techniques. There is pressure to reduce the level of phosphates from an environmental standpoint, and lower wash water temperatures to help conserve energy. The net effect is that many modern detergents and modern washing techniques are actually less efficient in removing certain types of stains. Furthermore, recourse to bleaching agents may be undesirable with respect to certain colors or types of fabrics. The proteolytic enzymes of this invention increase cleaning efficiency, even in low temperature washing. Furthermore, certain proteinaceous stains such as blood stains may actually be more difficult to remove with hot wash water. The hot water tends to denature the blood protein and thus "set" the stain, making it more difficult to solubilize.

DETERGENT COMPONENT

Anionic surfactants, nonionic surfactants, and mixtures thereof can be used in liquid, enzyme-containing detergent compositions of this invention. The commonest types of nonionic detergents are esters, ethers (or alkoxides), or polyhydric compounds. These esters, ethers, and polyhydric compounds have surface active properties by virtue of a hydrophobe/hydrophile balance which promotes "wetting", reduction of surface tension, foaming, defoaming, micelle formation, emulsification, or various other surface active phenomena. Typically, these are synthetic organic compounds with a hydrophobic portion (or oleophilic portion) and a hydrophilic portion. Alternatively, the compounds may have an essentially inorganic portion and an essentially organic portion, as in the case of the phosphate esters. The hydrophobic portion can be provided by aryl groups (including alkyl-aryl and aralkyl groups), aliphatic groups, oxyalkylene other than oxyethylene, and the like. The hydrophilic portion can be provided by hydroxyl groups, oxyethylene units, and the like. A typical formula for an oxyalkylene-containing nonionic surfactant is $RO\text{-}(AO)_nR'$, wherein R and R' are hydrogen, aliphatic groups, aryl groups, or the like, and the expression $(AO)_n$ is an oxyalkylene chain containing from one up to several hundred units; typically $(AO)_n$ is selected to provide a molecular weight of well over 200 for the nonionic surfactant molecule. The units in the oxyalkylene chain can be oxyethylene, oxypropylene, oxybutylene, or mixtures or block polymers thereof. A particularly effective way to adjust hydrophobe/hydrophile balance is to use random mixtures or alternating blocks of oxyethylene and 1,2-oxypropylene units.

Anionic surface active compounds typically used in detergent compositions contain a hydrophobic portion such as an alkyl group (including alkyl-aryl and aralkyl groups), an aliphatic chain, or the like and the anionic functional group or anion-forming functional group which is typically a sulfate, sulfonate, phosphate, carboxylate, or the like, or the corresponding sulfuric, sulfonic, phosphoric, or carboxylic acids, etc. Perhaps the most common synthetic organic anionic or anion-forming detergent compounds are the organic sulfuric and organic sulfonic acids, e.g. aliphatic sulfates and alkyl-aryl sulfonates or the corresponding acids. Where high-forming properties are desired (as in the foam-and-clean approach), alkyl-benzene sulfonic acids, and corresponding sulfonates are particularly useful. Also useful are alkyl ether sulfates and alkyl ester sulfosuccinates. Amphoteric surfactants such as substituted alkyl imidazoline derivates and substituted betaines may also be used. The most readily available high-foaming sulfonic acids or sulfonic acid salts are characterized by a hydrophobic portion comprising a benzene ring or other aryl group with a hydrocarbon "tail", typically a $C_8$–$C_{24}$ aliphatic chain, the most common of such chains being the straight-chain $C_{12}$ through $C_{18}$ alkyl groups. When sulfonate, sulfate, phosphate, or carboxylate salts are used, the cationic portion of the molecule is typically monovalent, e.g. an alkali metal or ammonium cation. Of the amines used to form ammonium cations, the alkanolamines are most typically used because of their hydrophilic nature and their relatively low toxicity. Foremost among these are mono-, di-, and triethanolamine.

The acid form of these anionic detergents can be used as such in detergent compositions. One common practice is to form alkanolamine salts or alkali metal salts in situ through the addition of the alkanolamine, the alkali metal hydroxide, or the like.

As is known in the art, amounts ranging from 1 to 70% by weight of the detergent can be used in aqueous liquid enzyme-containing detergent compositions. In the practice of this invention, the detergent concentration (based on the weight of the completely formulated aqueous liquid, enzyme-containing detergent composition) will range from about 2% by weight to as much as 50% by weight.

THE STABILIZING SYSTEM FOR THE ENZYME

As noted previously, enzyme-stabilizing systems of this invention include a water-dispersible antioxidant and an organic, hydrophilic, water-soluble polyol having a molecular weight less than about 500. Although this invention is not bound by any theory, it is believed that the key to the selection of a water-dispersible antioxidant is its $E°_{ox}$. It is frequently difficult to obtain complete E° data from the literature, since many reported values are not standardized for temperature and normality or molarity or "activity" of the reactants. For example, the *Merck Index*, 8th Edition (1968) gives the redox potential of ascorbic acid in terms of an E'° value at a pH of 5.0, which value is plus 0.217 volts. Furthermore, oxygenated sulfur anions such as thiosulfate, sulfite, bisulfite, and metabisulfite are oxidized in a complex fashion. Obtaining E° values for these oxidation reactions may involve some simplifying assumptions regarding the nature of the oxidized species resulting from these reactions and hence some simplifying assumptions regarding the equivalency or normality of the starting materials. A typical $E°_{ox}$ value for the oxidation of thiosulfate to sulfite is 0.58 volts, and a typical value for the oxidation of sulfite to sulfate is 0.90 volts. Other possible reaction products for the oxidation of oxygenated sulfur anions include sulfur dioxide, sulfur, and the like.

A reliable guide for the $E°_{ox}$ values of water-dispersible antioxidants useful in this invention is provided when one refers to specific antioxidant compounds. It has now been discovered that the redox potential should be at least equal to that of ascorbic acid but less than that of sodium hydrosulfite. Although this invention is not bound by any theory, it is believed that the hydrosulfite anion is too strong a reducing agent for use in this invention, and, as a result, denaturization of the proteolytic enzyme can occur in the presence of this particular type of antioxidant. On the other hand, various other oxygenated-sulfur anions having a redox potential greater than that of ascorbic acid but less than that of sodium hydrosulfite appear to provide optimum preservation of proteolytic enzyme activity. Among the preferred anions are the water-soluble divalent anions of the formula $S_aO_b$, wherein a and b are numbers greater than 0 but less than 8. Typical examples of such anions include metabisulfite ($S_2O_5^{--}$), sulfite ($SO_3^{--}$), and thiosulfate ($S_2O_3^{--}$) and also the corresponding monohydrogen monovalent species, particularly bisulfite ($HSO_3^-$). It is particularly convenient to introduce these anions in the form of their alkali metal salts, i.e. salts of the formula $$M_{2-n}^{\oplus}H_n^{\oplus}(S_aO_b^{--})$$

wherein $M^{\oplus}$ represents an alkali metal cation, n is a number selected from 1 and zero, and a and b are numbers greater than zero but less than 8. ($M^+$ is preferably $Na^+$ and/or $K^+$.) These anions may also be conveniently introduced in the form of their alkaline earth or amine salts.

Of these oxygenated sulfur anions, thiosulfate appears to be less desirable because of its relatively weak antioxidant activity. It may very well be that the primary benefit of the thiosulfate anion is the oxidation of chlorine-containing species in the water to chloride. It is presently theorized that these chlorine-containing species, typically present in most water supplies due to chlorination, can have a denaturing effect upon the proteolytic enzyme. The sulfite, bisulfite, and metabisulfite on the other hand (particularly metabisulfite and bisulfite) appear to protect the enzyme more directly against denaturization due to phenomena such as air oxidation.

Other antioxidants considered to fall within the useful range of redox potential include propyl gallate, the gluconate-glucose system, glutathione, thioglycolic acid, butylated hydroxy toluene (BHT), butylated hydroxyanisole, and t-butyl formaldehyde resin.

It is difficult to determine the desired concentration of antioxidant in terms of redox equivalents per liter, since the redox normality may be difficult to determine. Expressed in terms of molarity, a typical range for water soluble antioxidants is 0.01–1 mole per liter of the completely formulated detergent composition. In terms of weight-%, 0.1–5% by weight will be typical, based upon the weight of the completely formulated composition. The weight of the complete stabilizing system for the enzyme will typically range from 0.5 to 30% by weight of the complete detergent composition.

Organic, hydrophilic, water-soluble polyols used in combination with the antioxidants are typically liquid glycols or triols. As is known in the art, these glycols, triols, etc. can be monomeric, dimeric, trimeric, etc. Some patents even disclose relatively high polymeric polyols as enzyme-stabilizing agents; however, these are not preferred in this invention, the monomers, dimers, and trimers being particularly preferred for availability. All glycols or triols or higher polyhydric compounds do not work with equal effectiveness, and propylene glycol is particularly preferred. It is presently theorized that the polyol helps to reduce free water in the completely formulated detergent composition. As is known in the art, carbohydrates (e.g. simple sugars) and derivatives thereof (such as hexahydric alcohols) are hygroscopic and are thus very effective in reducing free water. From the standpoint of availability, polyols containing 2 to 6 hydroxyl groups are particularly preferred. The amount of the polyol may range from 1 to 25% by weight of the completely formulated detergent composition, amounts in excess of 5 weight-% being typical.

THE BUFFERING AGENT

Water-soluble chemical means for maintaining the pH of detergent compositions of this invention within the range of 5.2 to 9.0, despite any spontaneous oxidation of the antioxidant, can be, for example, weak bases or proton acceptors having a $pK_a$ within the range of about 6 to about 12. For example, alkanolamines protect against downward pH shifts by holding up the pH due to their weak basicity. In addition, these compounds form weak base/strong acid salts which also can exert a buffering effect against extreme upward pH changes, e.g. pH shifts above 9.0. A particularly effective range of proton acceptor or weak base is from about 0.02 to about 2 equivalents per liter of the totally formulated detergent composition. Good results are obtained, for example, with 0.05–1 equivalents per liter.

OTHER INGREDIENTS

Detergent compositions of this invention can contain, in addition to the ingredients described previously, coloring agents, biocidal agents, bleaching agents, thickeners, synthetic organic polymers such as polyvinyl pyrrolidone, and the like. Acidic agents such as low molecular weight aliphatic carboxylic acids can also be included (e.g. hydroxy acetic acid).

Organic or inorganic sequestering agents can be included in the composition as further protection against adverse effects of hard water, either in the composition itself or in the wash water. Perhaps the most effective of such sequestering agents are the condensed alkali metal phosphates; however, as noted previously, these may be objectionable for environmental reasons. In any event, compositions of this invention have proved useful in wash water which is either hard or soft.

USE OF STABILIZED LIQUID ENZYME-CONTAINING DETERGENTS IN FOAM AND CLEAN METHODS AND SYSTEMS

As noted previously, the "foam and clean" approach has a number of advantages, e.g. in cleaning large equipment or areas of food processing plants. The Kuhns et al patents, U.S. Pat. No. 3,961,754 was cited as an example of a typical foam and clean system. Foam cleaners have been employed in poultry and meat processing plants for the purpose of removing meat, fat, and blood residues. The requirements for a foam cleaner in this context are rather severe. Extremely high performance is needed to achieve adequate removal of these residues. In many cases, the soil-removing capability of prior art foam cleaners has been supplemented by hand scrubbing (particularly with highly alkaline detergents), high pressure cleaning, steam cleaning, and the like. The highly alkaline cleaners are hazardous and may attack various metal surfaces, e.g. surfaces comprising aluminum. On the other hand, the more mildly alkaline cleaners appear to lack the high performance needed in this application of the technology. It is a general rule of thumb that the more alkaline the cleaner, the more effective it is in stabilizing oily and fatty materials. A disadvantage of high temperature cleaning (e.g. steam cleaning) is that protein-containing soil may be coagulated or "set" and made more difficult to remove.

An aspect of the present invention is that the stabilized liquid enzyme containing detergent composition can be foamed on soiled surfaces and is very effective in removing meat, fat, and blood residues and the like. The effectiveness of the stabilized liquid enzyme detergent system can be greatly increased, particularly for foam-and-clean systems, if combined with suitable sequestering agents having a relatively high calcium stability constant. As noted previously, organic or inorganic sequestering agents can be included in the composition for a variety of reasons. In addition to the alkali metal phosphates, suitable sequestering agents include the carboxylic or phosphonic acid type in salt and/or acid form (amino- or nitrilocarboxylic acids or salts; amino- or nitrilophosphonic or organophosphonic acids or salts; poly[vinyl carboxylic] acids or salts such as the polyacrylates and similar polyelectrolytes; $C_2$–$C_{12}$ alpha-hydroxycarboxylic and -polycarboxylic acids or salts (such as gluconates, citrates, tartrates; etc.) or other chelating and sequestering agents having the ability to effectively tie up divalent cations such as the alkaline earth metal ions. For example, various mono- or oligosaccharide-like compounds (particularly in alcoholate form), polyamines, carbonyls or polycarbonyls, oxy compounds, alkali metal phenoxide or alkoxides, etc. can have an affinity for $Ca^{++}$ or $Mg^{++}$, the least toxic of these species being preferred. With respect to any of the foregoing alcoholates, carboxylates, phosphonates, and other salts, the cation or cations are selected so as not to interfere with the sequestering or chelating or potentiating or peptizing ability of the salt or acid or alcoholate. Monovalent cations (alkali metal, ammonium, etc.) with low chelate binding constants are preferred, e.g. $Na^+$ and $K^+$. The most effective nitrilocarboxylic and nitrilophosphonic chelating acids or salts have had at least one equivalent of protons replaced by a suitable monovalent cation equivalent and have calcium chelate binding constants in excess of 5 (e.g. >6). Tridentate or higher dentate chelators are preferred, but iminodiacetic acid is known to be an effective chelator. Of the inorganic phosphates or phosphoric acids, the condensed polyphosphates (typically having from 1 to 60 —$PO_3M$— units, wherein M is a suitable cation), e.g. pyrophosphates, tripolyphosphates, and the polymeric glassy polyphosphates are preferred.

In the context of the foam-and-clean applications of this invention, the sequestering or chelating agent serves a function which is not fully understood. Although this invention is not bound by any theory, it appears that the chelating or sequestering agent is either potentiating the enzyme or making the soil more susceptible to the peptization by the enzyme or both.

Under in-plant conditions, it has been found that the mixture of a stabilized enzyme-containing liquid detergent composition of this invention with suitable chelating or sequestering agents, when foamed onto various types of equipment. Conveyors, floors, walls, and the like, can remove soils with surprising effectiveness and do an excellent job of cleaning at low temperatures. The foams can be applied at normal ambient temperatures (e.g. 10°-27° C.) and rinsed off with a high pressure spray rinse at moderately elevated temperatures, e.g. 30°-50° C., more preferably 33°-37° C. Results obtained at 37° C. and below are considered surprising in view of the generally accepted concept that greasy or fatty soils cannot be effectively cleaned off below the melting point of the fat. Melting points of natural fats vary with the diet and geographic location, but it has been reported that some of the common natural fats typically melt at temperatures above 37° C., e.g. beef tallow, reported to melt at 42.5°-44.0° C. and chicken fat, reportedly melting at 38°-40° C. Pork fat is said to melt at lower temperatures, but even in the case of pork fat the melting range extends from 33.0° up to as high as 38.4° C.

Although the chelating or sequestering agent may be mixed with the other components of the stabilized enzyme-containing liquid detergent compositions during manufacture of the composition, thereby providing a one-part system, it is presently preferred to package the chelating or sequestering agent in a seperate container and ship the foam-and-clean composition as a two-part system. Two-part packaging is also preferred for cleaning-in-place detergent compositions, which are similar to the foam-and-clean compositions except for the typical use of surfactants with less tendency to form stable foams. The two parts or components can be mixed or combined on-site prior to or at the time of use; maximum potency of the enzyme is assured in this manner. In other words, Part A of the two-part system is preferably the stabilized enzyme-containing liquid detergent composition described previously. Part B comprises the sequestrant, preferably a blend of chelating agents, at least one of which should have a relatively high calcium stability constant. The pH of Part B can be higher than that of Part A, e.g. 12 or 13, if long term enzyme stability for the A/B blend is not required. Since the two-part composition is designed for a variety of job sites including food processing plants, it is particularly preferred that the chelating agent or agents be ecologically acceptable and generally recognized as safe in the context of foods and human use. The chelating agents with the longest use history in this field (including administration to humans as a medicament) are the salts of ethylene diamine tetraacetic acid (EDTA) and EDTA itself. In the United States, products used for cleaning food plants and food plant equipment must meet strict standards set by the U.S. Department of Agriculture.

To increase the formation of stable foam, the Part A (stabilized enzyme-containing liquid detergent component) can be fortified with high-foaming surfactants and foam stabilizers to provide a desirable wet foam when mixed with Part B at the use concentrations. A "wet foam" is one which contains a sufficient amount of liquid solution so as to be more active than a "dry foam", which contains a larger proportion of air. An advantage of a "dry foam" is that it may cling to vertical surfaces and the underside of horizontal surfaces more effectively; however, this type of foam tends to be less effective in soil removal. A typical wet foam can comprise 5 to 30 volume percent of solution and 95 to 70 volume percent of gas, e.g. air. Other gases besides air can be used to produce the foam, e.g. nitrogen, carbon dioxide, or other readily available gases. This desired ratio of liquid to air may vary with the viscosity of the solution. A solution in the form of a clinging gel can be applied instead of a foam. A factor believed to be closely related to soil removal (i.e. soil/enzyme/detergent interaction) is the dwell time. Foaming of the cleaning solution is considered to be a particularly convenient way to provide an adequate dwell time, particularly on surfaces from which draining occurs very rapidly, e.g. surfaces inclined from the horizontal.

In the following non-limiting Examples, all parts and percentages are by weight unless otherwise indicated.

EXAMPLE 1

This Example illustrates the effect on enzyme storage stability of stabilizing two enzyme-containing detergent systems with the enzyme stabilizing system of this invention. The detergent systems tested included propylene glycol, an organic, hydrophilic, water-soluble polyol. A water-soluble antioxidant and a buffering agent were added to the two detergent systems. The water-soluble antioxidant added was sodium metabisulfite and the buffering agent added was triethanolamine. For this Example the formulas without the enzyme stabilizing system have been designated as "Unstabilized" and those with the enzyme stabilizing system were designated as "Stabilized". The four formulas (two detergent systems) tested, two with and two without the enzyme stabilizing system, are set out below. The ingredients were added in the order listed and mixed together. All percentages are by weight.

| | Detergent System #1 | |
|---|---|---|
| | Unstabilized | Stabilized |
| Soft Water | 68.60 | 66.04 |
| Optical Brightener | 0.05 | 0.05 |
| Polyvinylpyrrolidone | 0.35 | 0.35 |

-continued

| Detergent System #1 | Unstabilized | Stabilized |
|---|---|---|
| Sodium Metabisulfate | — | 1.08 |
| Triethanolamine | — | 1.48 |
| Propylene Glycol | 10.00 | 10.00 |
| $C_{12}$-$C_{15}$ Linear, Primary Alcohol, 7 Mole Ethoxylate[1] | 20.00 | 20.00 |
| PB Enzyme TM Liquid[2] | 1.00 | 1.00 |
| | 100.00 wt. % | 100.00 wt. % |

[1]Neodol TM 25-7 from Shell Chemical Company.
[2]Product of G.B. Fermentation Industries Inc.

| Detergent System #2 | Unstabilized | Stabilized |
|---|---|---|
| Soft Water | 40.33 | 37.69 |
| Sodium Metabisulfite | — | 1.08 |
| Triethanolamine | — | 1.56 |
| Propylene Glycol | 7.00 | 7.00 |
| $C_{12}$-$C_{15}$ Linear, Primary Alcohol, 7 Mole Ethoxylate[1] | 35.00 | 35.00 |
| Sodium Dodecylbenzene Sulfonate (60% active)[2] | 16.67 | 16.67 |
| Enzyme Esperase TM slurry[3] | 1.00 | 1.00 |
| | 100.00 wt. % | 100.00 wt. % |

[1]Neodol TM 25-7 from Shell Chemical Company.
[2]Richonate 60-B TM from Richardson Company.
[3]Product of Novo Enzyme Corporation.

The four formulas were then subjected to 9 months accelerated storage at 37° C. (98° F.). The enzyme activity was measured initially and after 2 weeks, 4 weeks, 12 or 14 weeks, and 9 months. The test procedure used to determine the enzyme activity was the one described above in the specification. The percentages of enzyme activity remaining at the time of each measurement were determined and are listed below.

| Storage | Percent Enzyme Activity Remaining | | | |
|---|---|---|---|---|
| | Detergent System #1 | | Detergent System #2 | |
| Time (at 37° C.) | Unstabilized | Stabilized | Unstabilized | Stabilized |
| 0 | 100% | 100% | 100% | 100% |
| 2 weeks | 82% | 90% | 78% | 91% |
| 6 weeks | 51% | 86% | 44% | 75% |
| 12 weeks | 21% | 84% | — | — |
| 14 weeks | — | — | 3% | 58% |
| 9 months | 6% | 64% | 0% | 37% |

EXAMPLE 2

This Example compares the soil removal performance of a laundry detergent containing an enzyme stabilized with the enzyme stabilizing system of this invention against a non-enzyme commercial liquid laundry detergent. The commercial liquid laundry detergent used was Fluff TM, a product of Economics Laboratory, Inc. The composition of the stabilized enzyme-containing product used was:

| Ingredient | Percent by Weight |
|---|---|
| soft water | 66.15 |
| optical brightener | 0.05 |
| polyvinylpyrrolidone | 0.35 |
| sodium metabisulfite | 1.00 |
| triethanolamine | 1.25 |
| propylene glycol | 12.00 |
| $C_{12}$-$C_{15}$ linear, primary alcohol, 7 mole ethoxylate[1] | 18.00 |
| dye | 0.20 |
| Enzyme Esperase TM slurry[2] | 1.00 |
| | 100.00% |

[1]Neodol TM 25-7 from Shell Oil Company.
[2]Product of Novo Enzyme Corporation.

The soil removal was tested by using Institutional Product Development Test Procedure No. 16 of Economics Laboratory, Inc. The data provided by this test are reproducible and, in any event, show performance relative to the standard chosen for the test. The procedure involves using a Terg-o-tometer (from U.S. Testing) to wash standard soiled test cloth (from Test Fabrics, Inc. of Middlesex, N.J.) and reading the reflectivity of the cloth with a Hunter Lab Reflectometer before and after washing. The percent soil removal is then determined by comparing these readings to an initial reading taken on an unsoiled portion of the standard cloth. Two types of soiled cloth were tested: (1) Blood, Milk, and Chinese Ink (BMI) and (2) Cocoa, Milk, and Sugar (CMS).

The specific procedure followed was as follows. A number of swatches measuring approximately 3½ inches by 3½ inches were cut from the BMI and CMS soiled cloth. Approximately one-half of each swatch was soiled and one-half was unsoiled. The green reflectance reading (without the filter) was taken on both the soiled and the unsoiled portions of each swatch. The average reading on the unsoiled portions of the swatches was 92.71 and this is the value used in the calculations below.

The Terg-o-tometer was then adjusted to the desired temperature, either 38° C. (100° F.) or 60° C. (140° F.). The Terg-o-tometer was set at 150 rpm and 1000 mls of water was placed in each of the beakers of the Terg-o-tometer. Water of 75 ppm hardness as $CaCO_3$ (city water) and 200 ppm hardness as $CaCO_3$ (well water) were used. The temperature of the Terg-o-tometer and the water in the beakers were allowed to equalize. Approximately 0.25% by weight of water conditioner was added to both beakers. The composition of the water conditioner was:

| Ingredient | Percent by Weight |
|---|---|
| potassium hydroxide (45% solution) | 35% |
| tetrapotassium pyrophosphate (60% solution) | 15% |
| ethylene diamine tetra acetic acid-sodium salt (40% solution) | 15% |
| liquid silicate | 10% |
| carboxymethylcellulose | 1% |
| water | 24% |
| | 100% |

Approximately 0.1% by weight of the detergent being tested was added to each beaker. Two soiled swatches of the same type were placed in each beaker and agitated for ten minutes. The swatches were then removed and washed thoroughly with tap water and allowed to air dry. Reflectometer readings were then taken on the soiled portion of the swatches and the percent soil removal was calculated using the following formula:

$$\text{Percent Soil Removal} = \frac{L_f - L_i}{L_w - L_i} \times 100$$

Where:

$L_w$=the initial reflectance reading on the unsoiled portion of the swatch (92.71 during this test)

$L_f$=the reflectance reading on the soiled portion after washing and drying $L_i$=the reflectance reading on the soiled portion prior to washing The results of the test are set out in Table I. As indicated by the data in Table I, the stabilized enzyme-containing product of this invention out-performed the commercial product under all conditions tested.

TABLE I

SOIL REMOVAL COMPARISON

| Detergent | Water Hardness (ppm as CaCo3) | Water Temp. (°C.) | BMI Soil $L_i$ | BMI Soil $L_f$ | BMI Soil % Soil Removal | CMS Soil $L_i$ | CMS Soil $L_f$ | CMS Soil % Soil Removal |
|---|---|---|---|---|---|---|---|---|
| Enzyme[1] | 75 | 38 | 33.24 | 58.02 | 42 | 61.39 | 75.62 | 36 |
| | | | 33.03 | 58.62 | 42 | 61.79 | 72.90 | 37 |
| Commercial[2] | 75 | 38 | 33.85 | 46.53 | 22 | 61.38 | 69.56 | 27 |
| | | | 33.20 | 46.11 | 22 | 61.63 | 70.65 | 30 |
| Enzyme[1] | 200 | 38 | 33.41 | 54.06 | 35 | 61.41 | 69.49 | 26 |
| | | | 33.93 | 53.13 | 35 | 61.84 | 67.64 | 19 |
| Commerical[2] | 200 | 38 | 34.13 | 42.51 | 14 | 61.04 | 64.77 | 12 |
| | | | 33.12 | 45.95 | 22 | 61.06 | 65.99 | 16 |
| Enzyme[1] | 75 | 60 | 33.41 | 56.66 | 40 | 62.64 | 79.99 | 59 |
| | | | 33.91 | 57.43 | 39 | 61.51 | 80.11 | 61 |
| Commerical[2] | 75 | 60 | 33.21 | 48.95 | 26 | 61.69 | 72.21 | 35 |
| | | | 33.36 | 48.21 | 25 | 62.04 | 72.37 | 34 |
| Enzyme[1] | 200 | 60 | 33.30 | 57.55 | 41 | 60.85 | 73.86 | 42 |
| | | | 32.98 | 58.35 | 43 | 61.96 | 75.13 | 44 |
| Commerical[2] | 200 | 60 | 34.32 | 48.30 | 24 | 61.59 | 67.67 | 20 |
| | | | 33.41 | 46.93 | 23 | 62.02 | 68.83 | 23 |

[1]The stabilized enzyme containing product of this invention

[2]Fluff (trademark of Economics Laboratory, Inc.) A commercial, non-enzyme containing liquid laundry detergent.

EXAMPLE 3

This Example compares the effect on enzyme storage stability of using various sulfur-containing antioxidants and ascorbic acid in the stabilizing system of this invention to stabilize a laundry detergent containing PB Enzyme TM slurry (product of G. B. Fermentation Industries, Inc.). The six antioxidants tested were: sodium metabisulfite ($Na_2S_2O_5$); sodium bisulfite ($NaHSO_3$); sodium sulfite ($Na_2SO_3$); sodium thiosulfate ($Na_2S_2O_3$); sodium hydrosulfite ($Na_2S_2O_4.2H_2O$); and ascorbic acid.

The formulas tested are set out in Table II. All formulation percentages are by weight. All six antioxidants were tested at the same level, 1.25% by weight.

The ingredients were added and mixed in the order listed. The original protease assay (enzyme activity) for each formula is indicated in casein units per gram (cu/g) in Table II. (The "cu/g" unit has been defined previously.) The percentage activity remaining for each formula after 1, 2, and 3½ months of accelerated (at 37° C.) aging is also listed in Table II.

The Enzyme storage stability was good when sodium metabisulfite, sodium bisulfite, sodium sulfite, and ascorbic acid were used. Sodium thiosulfite also stabilized enzyme activity but not to the same degree. Sodium hydrosulfite was actually detrimental to enzyme activity, apparently because it is too strong of a reducing agent.

The systems utilizing sodium sulfite and sodium thiosulfate did not contain a buffering agent, i.e. triethanolamine, which may partially explain why they did not perform as well as sodium metabisulfite and sodium bisulfite.

TABLE II

| Ingredients | None | Antioxidant: Sodium Metabisulfite | Sodium Bisulfite | Sodium Sulfite | Sodium Thiosulfate | Sodium Hydrosulfite | Ascorbic Acid |
|---|---|---|---|---|---|---|---|
| Soft water | 68.40 | 65.15 | 65.15 | 67.00 | 67.15 | 65.90 | 65.90 |
| Polyvinylpyrrolidone | 0.35 | 0.35 | 0.35 | 0.35 | 0.35 | 0.35 | 0.35 |
| Optical Brightener | 0.05 | 0.05 | 0.05 | 0.05 | 0.05 | 0.05 | 0.05 |
| Triethanolamine, 99% | — | 2.00 | 2.00 | — | — | 1.25 | 1.25 |
| Antioxidant | — | 1.25 | 1.25 | 1.25 | 1.25 | 1.25 | 1.25 |
| Hydroxyacetic Acid, 70% | — | — | — | 0.15 | — | — | — |
| Propylene Glycol | 12.00 | 12.00 | 12.00 | 12.00 | 12.00 | 12.00 | 12.00 |
| $C_{12}$–$C_{15}$, linear, primary alcohol, 7 mole ethoxylate Neodol TM 25-7) | 18.00 | 18.00 | 18.00 | 18.00 | 18.00 | 18.00 | 18.00 |
| Dye | 0.20 | 0.20 | 0.20 | 0.20 | 0.20 | 0.20 | 0.20 |
| P.B. Enzyme Slurry TM | 1.00 | 1.00 | 1.00 | 1.00 | 1.00 | 1.00 | 1.00 |
| | 100.00% | 100.00% | 100.00% | 100.00% | 100.00% | 100.00% | 100.00% |
| Original Protease Assay (cu/gm) | 469 | 482 | 489 | 470 | 491 | 422 | 512 |
| Percent Enzyme Activity Remaining After Storage at 37° C. for: 1 Month | 74% | 89% | 90% | 82% | 83% | 85% | 89% |

TABLE II-continued

| Ingredients | None | Antioxidant: Sodium Metabisulfite | Sodium Bisulfite | Sodium Sulfite | Sodium Thiosulfate | Sodium Hydrosulfite | Ascorbic Acid |
|---|---|---|---|---|---|---|---|
| 2 Months | 45% | 95% | 98% | 91% | 80% | 43% | 88% |
| 3½ Months | 26% | 95% | 96% | 88% | 73% | 18% | 88% |

EXAMPLE 4

This example is the same as Example 3 except that Enzyme Esperase TM slurry (product of Novo Enzyme Corporation) was substituted for PB Enzyme TM slurry. The antioxidants tested and all components and percentages were the same as in Example 3. The original protease assay in casein units per gram (cu/gm) for each formula and the results of a two month accelerated (37° C.) storage test are set out in Table III.

The enzyme stability was good when sodium metabisulfite and sodium bisulfite were used. Sodium thiosulfate and ascorbic acid protected enzyme activity to some extent but not as well as sodium metabisulfite and sodium bisulfite. Sodium hydrosulfite was, as in Example 3, detrimental to enzyme activity.

TABLE III

| | None | Antioxidant: Sodium Metabisulfite | Sodium Bisulfite | Sodium Sulfite | Sodium Thiosulfate | Sodium Hydrosulfite | Ascorbic Acid |
|---|---|---|---|---|---|---|---|
| Original Protease Assay (cu/gm) | 372 | 372 | 377 | 345 | 381 | 343 | 370 |
| Percent Enzyme Activity Remaining After Storage at 37° C. for: | | | | | | | |
| 1 Month | 81% | 105% | 103% | 110% | 84% | 94% | 90% |
| 2 Months | 62% | 102% | 103% | 63% | 70% | 0% | 69% |

The systems utilizing sodium sulfite and sodium thiosulfate did not contain a buffering agent, i.e. triethanolamine, which may partially explain why they did not perform as well as sodium metabisulfite and sodium bisulfite.

EXAMPLE 5

This example illustrates the effect on enzyme storage stability of not including an organic, hydrophilic, water-soluble polyol, e.g. propylene glycol, in the enzyme stabilizing system of this invention. The antioxidant used for this test was sodium metabisulfite. Both PB Enzyme TM liquid and Enzyme Esperase TM slurry were tested in three formulations:

(1) with the polyol, without the antioxidant, and without the buffering agent;

(2) with the polyol, with the antioxidant, and with the buffering agent;

(3) without the polyol, with the antioxidant, and with the buffering agent.

The formulas used are set out in Table IV (Enzyme Esperase TM slurry) and Table V (PB Enzyme TM liquid) where all percentages are by weight. The ingredients were added and mixed in the order listed. The original protease activity in casein units per gram (cu/gm) and the results of the accelerated (at 37° C.) storage test are also set out in Tables IV and V.

TABLE IV

| Ingredient | With polyol, without antioxidant and buffering agent | With polyol, antioxidant and buffering agent | Without polyol, with antioxidant and buffering agent |
|---|---|---|---|
| Soft Water | 47.8 | 45.55 | 55.55 |
| Triethanolamine, 99% | — | 1.25 | 1.25 |
| Sodium Metabisulfite | — | 1.00 | 1.00 |
| Polyvinyl Alcohol Resin[1] | 1.0 | 1.00 | 1.00 |
| Sodium Xylene Sulfonate, 40% | 5.0 | 5.00 | 5.00 |
| Propylene Glycol | 10.0 | 10.00 | — |
| $C_{12}$–$C_{15}$ Linear, Primary Alcohol, 7 Mole Ethoxylate[2] | 30.0 | 30.00 | 30.00 |
| Sodium Petroleum Sulfonate, 62%[3] | 5.0 | 5.00 | 5.00 |
| Dye | 0.2 | 0.20 | 0.20 |
| Enzyme Esperase TM Slurry[4] | 1.0 | 1.00 | 1.00 |
| | 100.0 wt. % | 100.00 wt. % | 100.00 wt. % |
| Original Protease Assay (cu/gm) | 471 | 526 | 493 |
| Percent Enzyme Activity Remaining After Storage at 37° C. for: | | | |
| 1 Month | 70% | 112% | 57% |
| 2 Months | 58% | 99% | 45% |

TABLE IV-continued

| Ingredient | With polyol, without anti-oxidant and buffering agent | With polyol, antioxidant and buffer-ing agent | Without polyol, with antioxidant and buffering agent |
|---|---|---|---|
| 3½ Months | 47% | 89% | 37% |

[1]PVA, Gelvatrol TM (40/10) from Monsanto Company.
[2]Neodol TM 25-7 from Shell Chemical Company.
[3]Petronate TM HL from Witco Chemical Corporation.
[4]Product of Novo Enzyme Corporation.

TABLE V

| Ingredients | With polyol, without anti-oxidant and buffering agent | With polyol, antioxidant, and buffer-ing agent | Without polyol, with antioxidant and buffering agent |
|---|---|---|---|
| Soft Water | 48.8 | 46.55 | 56.55 |
| Triethanolamine, 99% | — | 1.25 | 1.25 |
| Sodium Metabisulfite | — | 1.00 | 1.00 |
| Sodium Xylene Sulfonate, 40% | 5.0 | 5.00 | 5.00 |
| Propylene Glycol | 10.0 | 10.00 | — |
| $C_{12}$-$C_{15}$ Linear, Primary Alcohol, 7 Mole Ethoxylate[1] | 30.0 | 30.00 | 30.00 |
| Sodium Petroleum Sulfonate, 62%[2] | 5.0 | 5.00 | 5.00 |
| Dye | 0.2 | 0.20 | 0.20 |
| PB Enzyme TM Liquid[3] | 1.0 | 1.00 | 1.00 |
| | 100.0 wt. % | 100.00 wt. % | 100.00 wt. % |
| Original Protease Assay (cu/gm) | 305 | 326 | 313 |
| Percent Enzyme Activity Remaining After Storage at 37° C. for: | | | |
| 1 Month | 19% | 92% | 81% |
| 3 Months | 0 | 103% | 83% |

[1]Neodol TM 25-7 from Shell Chemical Company.
[2]Petronate TM HL from Witco Chemical Company.
[3]Product of G.B. Fermentation Industries, Inc.

The data in Tables IV and V indicate that the presence of an organic, hydrophilic, water-soluble polyol, e.g. propylene glycol, improves the stabilizing effect of an antioxidant on enzyme activity. The improvement was apparently more significant when Enzyme Esperase TM slurry was used than when PB Enzyme TM liquid was used.

EXAMPLE 6

This example illustrates the effect on enzyme storage stability of increasing the amount of antioxidant and buffering agent, in an enzyme-containing foam-on cleaner stabilized with the stabilizing system of this invention. The antioxidant used was sodium metabisulfite and the buffering agent used was triethanolamine. As the amount of sodium metabisulfite was increased the amount of triethanolamine was correspondingly increased so that it would sufficiently buffer the increased level of sodium metabisulfite. The percentage of sodium metabisulfite was varied from 0.5% to 2.0%. The four formulas tested are set out in Table VI. The ingredients were added and mixed in the order listed. All percentages are by weight.

TABLE VI

| Ingredients | Level of Antioxidant | | | |
|---|---|---|---|---|
| | 0.5% Sodium Metabisulfite | 1.0% Sodium Metabisulfite | 1.5% Sodium Metabisulfite | 2.0% Sodium Metabisulfite |
| Soft Water | 55.36 | 54.06 | 52.66 | 51.36 |
| Sodium Metabisulfite | 0.50 | 1.00 | 1.50 | 2.00 |
| Triethanolamine, 99% | 0.90 | 1.70 | 2.60 | 3.40 |
| Propylene Glycol | 10.00 | 10.00 | 10.00 | 10.00 |
| Linear Alkyl Benzene Sulfonic Acid, 97% | 3.80 | 3.80 | 3.80 | 3.80 |
| Sulfate Ethoxylated Alcohol Derivative, 58%[1] | 2.19 | 2.19 | 2.19 | 2.19 |
| Coconut Alkanolamide, 100%[2] | 8.75 | 8.75 | 8.75 | 8.75 |
| Ethoxylated $C_6$-$C_{10}$ Linear Alcohol, 50% Weight Ethylene Oxide[3] | 17.50 | 17.50 | 17.50 | 17.50 |
| Enzyme Esperase TM Slurry[4] | 1.00 | 1.00 | 1.00 | 1.00 |
| | 100.00 wt. % | 100.00 wt. % | 100.00 wt. % | 100.00 wt. % |

[1]Alfonic TM 1412-S from Conoco Chemicals.
[2]Clindrol TM 206 CGN from Clintwood Chemical.
[3]Alfonic TM 610-50 from Conoco Chemicals.
[4]Product of Novo Enzyme Corporation.

The original protease assay in casein units per gram (cu/gm) for each formula and the percentage of enzyme activity remaining after 1, 2 and 3 months of accelerated storage (37° C.) were as follows:

| | Percent of Sodium Metabisulfite | | | |
|---|---|---|---|---|
| | 0.5% | 1.0% | 1.5% | 2.0% |
| Original Protease Assay (cu/gm) | 337 | 364 | 325 | 376 |
| Percent Activity Remaining After Storage at 37° C. for: | | | | |
| 1 Month | 64% | 78% | 85% | 92% |
| 2 Months | 47% | 68% | 76% | 89% |
| 3 Months | 41% | 65% | 79% | 94% |

The results of this test indicate that as the concentration of antioxidant and buffering agent are increased the stabilization effect on the enzyme is increased.

EXAMPLES 7-A to 9-A

Each of these exemplary formulations is suited to serve as the Part A of a two-part foam-and-clean system, and Example 8A is particularly well suited for this use.

| | Percent by Weight | | |
|---|---|---|---|
| Ingredient | Ex. 7-A | Ex. 8-A | Ex. 9-A |
| Water | Q.S. | 53.96 | Q.S. |
| Sodium xylene sulfonate (40% Active) | 3.0 | 4.32 | 6.0 |
| Sodium metabisulfite | 0.75 | 1.44 | 3.0 |
| Propylene glycol | 5.0 | 8.35 | 12.0 |
| Triethanolamine[1] | 2.0 | 2.30 | 4.0 |
| Linear $C_{10-12}$ alcohol ethoxylate (4.5 moles EO[2]) | 1.0 | 2.88 | 5.0 |
| Linear $C_9$-$C_{11}$ alcohol ethoxylate (6.0 moles EO[2]) | 1.0 | 2.16 | 5.0 |
| Sodium fatty alcohol ether sulfate (60% Active) | 1.0 | 2.88 | 5.0 |
| 2-alkyl-1 (ethyl-beta-oxipropanoic acid imidazoline, Na Salt | 0.5 | 2.30 | 5.0 |
| Nonyl phenol ethoxylate[3] | 1.0 | 2.88 | 5.0 |
| Diethanol coconut amide | 1.0 | 5.90 | 10.0 |
| Sodium dioctyl sulfosuccinate (70% Active) | 1.0 | 3.88 | 5.0 |
| Linear $C_9$-$C_{11}$ alcohol ethoxylate (2.5 moles EO[2]) | 1.0 | 2.88 | 5.0 |
| Linear $C_6$-$C_{10}$ alcohol ethoxylate (2.75 moles EO[2]) | 1.0 | 2.88 | 5.0 |
| Esperase slurry pH as is, 8.0 | 0.5 | 1.00 | 5.0 |

NOTES
[1]The amount used is primarily dependent on the desired pH but should be sufficient to provide pH stability.
[2]Ethylene oxide.
[3]NPE 9.5.

EXAMPLES 7-B to 9-B

Each of these exemplary formulations is useful as a Part B with Examples 7-A, 8-A, or 9-A. The various additives were selected with cost-effectiveness, terminal pH as well as the final pH of blends of Parts A and B in mind. The ethylenediaminetetraacetic acid, tetra sodium salt (EDTA $Na_4$) was added as a 50% active solution.

| | Percent by Weight | | |
|---|---|---|---|
| Ingredients | Ex. 7-B | Ex. 8-B | Ex. 9-B |
| Water | Q.S. | 70.5 | Q.S. |
| Sodium gluconate | 0.25 | 0.5 | 2.0 |
| Sodium tripolyphosphate | 1.0 | 5.0 | 7.0 |
| Sodium polyphosphate[1] | 1.0 | 8.0 | 10.0 |
| EDTA $Na_4$, 50% act. solution | 1.0 | 16.0 | 20.0 |

NOTES
[1]The sodium polyphosphate is a glassy polyphosphate with 67% $P_2O_5$ content manufactured by the FMC Corporation, Inorganic Chemicals Division.

EXAMPLE 10

Synergism Between Part A and Part B

In order to determine optimum concentrations needed a laboratory evaluation test on the effectiveness of the cleaner was carried out. Stainless steel test panels measuring 7.62×7.62 cm were soiled with approximately 0.5 grams of (ground beef) hamburger spread uniformly over the entire area, dried for two hours at room temperature (about 18°-25° C.). Various concentrations of Example 8-A and Example 8-B were made up in 15 grain (as $CaCO_3$) hard water. The panels were soaked for 5 minutes at solution temperature of about 16° C. (ambient). The panels were then rinsed under cold tap water (about 12° C.). The evaluation of "% clean" was an estimate of the area in which no visible soil remained, i.e. 50% clean represents a panel in which no visible soil was present in 50% of the area and 100% clean indicates a panel in which no visible soil was present after cleaning. This data is summarized in the following table:

| Product of Example 8-A | |
|---|---|
| % Solution (W/W) | % Clean |
| 1 | 50 |
| 2 | 55 |
| 3 | 70 |
| 4 | 90 |

| Product of Example 8-B | |
|---|---|
| % Solution (W/W) | % Clean |
| 1 | 10 |
| 2 | 10 |
| 3 | 10 |
| 4 | 10 |

| Equal Weight Mixtures of Product of Example 8-A/Example 8-B | |
|---|---|
| % Solution Ex. 8-A/Ex. 8-B | % Clean |
| 0.5/0.5 | 95 |
| 1.0/1.0 | 98 |
| 1.5/1.5 | 100 |
| 2.0/2.0 | 100 |

As may be seen from the above Examples, the product of Example 8-A showed a progressive improvement as the concentration was varied from 1 to 4%. Product of Example 8-B on the other hand showed no improvement in going from 1 to 4% and the soil removal was very limited. When the two components were mixed very high degree of soil removal was realized. Stated another way, at a 1% level, the products of Example 8-A gave a 50% clean rating and the product of Example 8-B gave 10% clean rating, cumulatively giving a 60% clean surface. However, when these two components were mixed together it resulted in a 98% clean surface. Likewise at 2% concentrations the cumulative results were 65% separately, but 100% when the two components were mixed. As a matter of fact, when combined, 100% clean rating was obtained at 1.5% concentration of each component. Thus, the results appear to be synergistic, i.e. greater than additive.

EXAMPLES 11-14

Other sequestering agents and water conditioners were substituted for tetrasodium ethylene diamine tetra acetic acid at a concentration of 5.0% active basis in the formulation shown in Example 8-B. The remainder of the components in Example 8-B remained the same, water being added to make up to 100%. The soil removal tests were carried out in a manner as indicated for data summarized for Example 10. The percent concentration of modified Example 8-A/Example 8-B was 1.5%/1.5%. The chelator used in the Part B and the result in "% clean" is summarized in the table below:

| Example | Chelator Used in Part B | % Clean |
|---|---|---|
| 11 | Nitrilotriacetate trisodium salt | 99+ |
| 12 | 1,2-diamino cyclohexane tetra acetic acid | 99 |
| 13 | Ethylene diamine tetra (methylene phosphonic acid) | 99 |
| 14 | Sodium polyacrylate | 99 |

The sodium polyacrylate used in the above test has a molecular weight of about 3,000 based on intrinsic viscosity.

The above data compares with the Example 8-A/Example 8-B 1.5/1.5 weight mixture of Example 10 which gave a 100% clean result. The above data appears to suggest that chelating agents and calcium binding compounds or seguestrants in general are synergistic with the stabilized liquid enzyme preparation.

For example, good results were obtained with a sequestrant of the alkali metal salt polyelectrolyte type (in this case an acrylate). Accordingly, the synergistic effect is not believed to be dependent upon either the nitrilo polydentate structure or the alpha-hydroxycarboxylate structure. Nevertheless, a preferred class of sequestering or chelating agents can be represented by the formula $$R[CH_2A^{\ominus}M^{\oplus}]_a$$

wherein $A^{\ominus}$ is $—COO^{\ominus}$ or $—PO(OM)O^{\ominus}$ or the like; $M^{\oplus}$ is the preferred type of monovalent cation described previously; R is disubstituted nitrilo (i.e. imino or organic amino) or trisubstituted nitrilo, including organicpolynitrilo such as ethylenediamino, diaminocyclohexane, etc.; and a is a number from 2 to about 6, e.g. an integer from 2 to 5. In accordance with the foregoing Examples, this preferred class of agents is preferably blended with a suitable phosphate and/or a hydroxycarboxylic and/or polycarboxylic chelating or sequestering agent.

EXAMPLE 15

The following composition illustrates a typical two-part, low-foaming clean-in-place formula. The ethylene oxide/propylene oxide/ethylene diamine surfactant and the amine-polyglycol condensate were included in the formula so that any foam which would be formed would have relatively short-term stability.

Part A

| % by Weight | Ingredient |
|---|---|
| 46 | soft water |
| 1 | sodium metabisulfite |
| 1 | triethanolamine |
| 15 | sodium xylene sulfonate (40% active) |
| 15 | $C_6$-$C_{10}$ linear alcohol ethoxylate containing 50 weight-% ethylene oxide (ALFONIC 610-50, trademark of Conoco Chemicals) |
| 10 | propylene glycol |
| 5.5 | amine-polyglycol condensate (low foaming surfactant; TRITON CF-32, trademark of Rohm & Haas Co.) |
| 5.5 | propylene oxide/ethylene diamine product further reacted with ethylene oxide (TETRONIC 701, trademark of BASF-Wyandotte) |
| 1 | esperase slurry (see preceding Examples). |

Part B

| % by Weight | Ingredient |
|---|---|
| 7 | polyacrylic acid polyelectrolyte (50% active) |
| 80 | potassium hydroxide, aqueous solution (45% active) |
| 13 | colloidal sodium silicate dispersed in water (water glass), $SiO_2/NO_2O$ ratio 3.22:1 ("Silicate E" [trademark]) |

The pH of Part B was considerably higher than Part A, such that when Part B was blended with Part A in a 3.2:1 (weight:weight) ratio, with dilution, to make a liter of cleaner (e.g. 0.25 g/L of A and 0.8 g/L of B), the resulting pH was typically 11 or 12. At this pH and 50° C., 83% of the enzyme activity of the blend remained after one hour. Higher temperatures caused a faster deterioration of enzyme activity of the blend.

What is claimed is:

1. A two-part, cleaning system consisting essentially of a first, proteolytic enzyme-containing part and a second, relatively more alkaline part associated therewith, each part being separately packaged to assure maximum potency of the proteolytic enzyme until the two parts are blended together, comprising:

(I) in a first, proteolytic enzyme-containing part, the composition comprising:

(a) 20-90% by weight of water;

(b) a proteolytically effective amount of a proteolytic enzyme uniformly distributed throughout said water; said proteolytically effective amount ranging from about 0.001 to about 1% by weight on a pure enzyme basis;

(c) 1-70% by weight of a detergent selected from the group consisting of anionic surfactants, nonionic surfactants, and mixtures thereof; said detergent being uniformly distributed throughout said water;

(d) 0.5-30% by weight of a water-dispersible stabilizing system for said enzyme, dissolved in said water, said system comprising the combination of:

(1) a proteolytic enzyme-stabilizing amount ranging from about 0.1 to about 5% by weight of a water-dispersible antioxidant having a single electrode potential, at 25° C., for the oxidation of said antioxidant to an oxidized species, which is at least equal to that of ascorbic acid but less than that of sodium hydrosulfite;

(2) about 1 to about 25% by weight of an organic, hydrophilic, water-soluble polyol containing from 2 to 6 hydroxyl groups and having a molecular weight less than about 500;

(3) a buffering amount of a weak base for maintaining the pH of said composition within the range of 5.2 to 9.0 and for preventing spontaneous downward pH shifts of said first part, which shifts would result from the spontaneous oxidation of said anion;

(II) in a second, relatively more alkaline part, formulated for blending with said first, proteolytic enzyme-containing part to increase the cleaning effectiveness of said first part, a composition comprising a chelating or sequestering agent for sequestering alkaline earth metal cations.

2. A system according to claim 1 wherein said stabilizing system comprises:

(1) an alkali metal salt of the formula $M_{2-n}^{\oplus}H_n^{\oplus}(S_aO_b^{--})$ wherein $M^{\oplus}$ represents an alkali metal cation, n is a number selected from 1 and zero, and a and b are numbers greater than zero but less than 8, (2) a said polyol, said polyol being liquid glycol or triol, and (3) an alkanolamine buffering agent; said composition being sufficiently stabilized to maintain at least 80% of its initial enzyme activity over a period of at least two months.

3. A system according to claim 1 wherein said second part includes an alkali metal aminocarboxylate having at least two dentate groups.

4. A composition according to claim 1 wherein said detergent of said component (c) is a high-foaming surfactant and wherein said first part and said second part have been combined and diluted with water to a concentration of 0.5–4% by weight.

5. A composition according to claim 1 wherein said detergent of said component (c) is a non-stable foam-forming surfactant.

6. A two-part cleaning system according to claim 1 wherein said water-dispersible antioxidant consists essentially of a water-soluble metal salt of an oxidizable, oxygenated-sulfur anion; said buffering amount of said weak base is sufficient to maintain the pH within the range of 6.0 to about 8.0; and wherein said first, proteolytic enzyme-containing part contains 0.5 to 2 parts by weight, based on the total weight of said composition, of a slurry of said proteolytic enzyme.

7. A system according to claim 1, wherein said first part comprises:

(a) 30–90% by weight of water;

(b) uniformly distributed throughout said water, a said proteolytically effective amount of a proteolytic enzyme having an enzyme activity ranging from about 100 to about 1,000 casein units per gram;

(c) uniformly distributed throughout said water, 1–70% by weight of a high-foaming detergent comprising a blend including at least one anionic surfactant and at least one nonionic surfactant;

(d) dissolved in said water, 1–25% by weight of said water-soluble liquid organic hydrophilic polyol;

(e) dissolved in said water, 0.1–1 mole, per liter of said composition, of a water soluble alkali metal salt containing an oxidizable, oxygenated-sulfur anion, said anion being selected from the group consisting of sulfite, bisulfite, metabisulfite, and thiosulfate; and (f) dissolved in said water, a buffering amount of a weak base for maintaining the pH of said detergent composition within the range of 5.2 to 9.0, despite any spontaneous oxidation of said anion of said alkali metal salt; and wherein said second part comprises a blend of sequestering or chelating agents including at least one aminocarboxylic-type or phosphonic-type chelating agent having a calcium binding constant above about 6.

8. A system according to claim 7 wherein said weak base is a proton acceptor having a $pK_a$ within the range of about 6 to about 12, and wherein the concentration of said proton acceptor ranges from about 0.02 to about 2 equivalents per liter of said composition.

9. A detergent system according to claim 1 wherein said water soluble antioxidant is selected from the group consisting of an alkali metal bisulfite, an alkali metal metabisulfite, and mixtures thereof.

10. A system according to claim 9 wherein said polyol is a monomeric, dimeric, or trimeric polyol having two or three hydroxyl groups.

11. An aqueous cleaning composition diluted with water to use a concentration of at least 0.25 g per liter of diluted cleaning composition, said composition comprising a blend of a plurality of separately formulated parts, including a cleaning amount up to 4% by weight each of a first part and a second part;

said first part consisting essentially of;

(a) 20–90% by weight of water;

(b) a proteolytically effective amount of a proteolytic enzyme uniformly distributed throughout said water; said proteolytically effective amount ranging from about 0.001 to about 1% by weight on a pure enzyme basis;

(c) 1–70% by weight of a detergent selected from the group consisting of anionic surfactants, nonionic surfactants, and mixtures thereof; said detergent being uniformly distributed throughout said water;

(d) 0.5–30% by weight of a water-dispersible stabilizing system for said enzyme, dissolved in said water, said system comprising the combination of:

(1) a proteolytic enzyme-stabilizing amount ranging from about 0.1 to about 5% by weight of a water-dispersible antioxidant having a single electrode potential, at 25° C., for the oxidation of said antioxidant to an oxidized species, which is at least equal to that of ascorbic acid but less than that of sodium hydrosulfite;

(2) about 1 to about 25% by weight of an organic, hydrophilic, water-soluble polyol containing from 2 to 6 hydroxyl groups and having a molecular weight less than about 500;

(3) a buffering amount of a weak base for maintaining the pH of said composition within the range of 5.2 to 9.0 prior to blending with said second part and for preventing spontaneous downward pH shifts of said first part prior to blending with said second part, which shifts would result from the spontaneous oxidation of said anion;

said second part consisting essentially of a chelating or sequestering agent for sequestering alkaline earth metal cations.

12. A method for removing proteinaceous soil from a hard surface comprising the steps of applying a foam-on product with the composition of claim 11, and rinsing said product from said hard surface.

13. A method for removing soil from apparatus by in-place cleaning comprising the steps of applying a cleaning-in-place product with the composition of claim 11, and rinsing said product from said apparatus.

14. A composition according to claim 11 wherein said proteolytic enzyme has an enzyme activity ranging from about 100 to about 1,000 casein units per gram; said water-dispersible antioxidant consists essentially of a water-soluble metal salt of an oxidizable, oxygenated-sulfur anion, said anion being selected from the group consisting of sulfite, bisulfite, metabisulfite, and mixtures thereof; and said buffering amount of said weak base is sufficient to maintain the pH within the range of 6.0 to about 8.0; and wherein said first part and said second part have been diluted with water to a concentration ranging from about 0.5 to about 2% by weight.

* * * * *

UNITED STATES PATENT AND TRADEMARK OFFICE

CERTIFICATE OF CORRECTION

PATENT NO. : 4,243,543

DATED : January 6, 1981

INVENTOR(S) : C. Carol Guilbert & William H. Scepanski

It is certified that error appears in the above–identified patent and that said Letters Patent are hereby corrected as shown below:

Column 3, line 5, for "of combination" read --or combination--.
Column 4, line 25, for "beta-imidazoleopropionic" read --beta-imidazolepropionic--.
Column 4, line 48, for "becomes" read --become--.
Column 6, line 33, for "buffereing" read --buffering--.
Column 7, line 32, for "ore" read --or--.
Column 8, line 7, for "93° F." read --98° F.--.
Column 10, line 19, for "0.217" read --0.127--.
Column 12, line 22, for "patents" read --patent--.
Column 13, line 56, for "seperate" read --separate--.
Column 25, line 44, for "seguestrants" read --sequestrants--.

Column 25, line 55, for "$R[CH_2A^{\ominus}M^{\oplus}[_a$" read --$R[CH_2A^{\ominus}M^{\oplus}]_a$--.
Column 26, line 36, for "$NO_2O$" read --$Na_2O$--.

Signed and Sealed this

Twentieth Day of October 1981

[SEAL]

Attest:

GERALD J. MOSSINGHOFF

Attesting Officer

Commissioner of Patents and Trademarks